United States Patent [19]

Smakula

[11] Patent Number: 4,508,003

[45] Date of Patent: Apr. 2, 1985

[54] TRUSS ROD APPARATUS

[76] Inventor: Peter H. Smakula, 2077 Cornell Rd., Cleveland, Ohio 44106

[21] Appl. No.: 428,625

[22] Filed: Sep. 30, 1982

[51] Int. Cl.[3] ..... G10D 3/00

[52] U.S. Cl. ..... 84/293

[58] Field of Search ..... 84/293

[56] References Cited

U.S. PATENT DOCUMENTS

| | | | |
|---|---|---|---|
| 2,460,943 | 2/1949 | Nelson | 84/293 |
| 3,143,028 | 8/1964 | Fender | 84/293 |
| 3,416,399 | 12/1968 | Baldoni | 84/293 |
| 4,308,780 | 1/1982 | Boucher | 84/293 |

FOREIGN PATENT DOCUMENTS

| | | | |
|---|---|---|---|
| 150971 | 4/1953 | United Kingdom | 84/293 |

*Primary Examiner*—Lawrence R. Franklin

*Attorney, Agent, or Firm*—Porter & Bremer Co.

[57] ABSTRACT

A truss rod apparatus, for use within the neck of a stringed musical instrument, to correct both concave and convex warping of the instrument's neck. The apparatus includes a first and second rod, the rods lying parallel to each other in a groove within the instrument's neck. The groove and truss rod apparatus are overlaid by a fingerboard. The rods are fastened together at one pair of their ends. The opposite end of the first rod is fastened to an anchor block, holding the rod axially and radially immobile. The opposite end of the second rod is threaded, engaging with internal threads of a hollow bolt. The hollow bolt itself threads with a passageway through the anchor block. Upon rotation of the bolt, the effective length of the second rod may be increased or decreased without rotating the rod, causing either a concave or convex bow in the rod pair. Where the first and second rod lengths are equal, the rods lay straight, imparting no forces on the instrument neck. The apparatus is easily replaceable without dismantling of the instrument's neck.

13 Claims, 6 Drawing Figures

TRUSS ROD APPARATUS

BACKGROUND OF THE INVENTION

1. Field of the Invention

The invention relates to stringed musical instruments and, more particularly, to an apparatus internal to the neck of the instrument for adjusting the curvature of the neck.

2. Description of the Prior Art

Stringed musical instruments such as banjos and guitars have been known for many years. In these instruments, tightly wound strings are stretched from the end of a long neck to the base of a sound box to which the neck is fastened. Sound is produced by the vibration of the strings when plucked or when a bow is drawn across them, the sound being amplified by the sound box. Because the strings are stretched tightly from the end of the neck to the base of the sound box, a great deal of tension is placed on the neck; the point on the sound box where the neck is attached acting as a fulcrum. Thus, in response to the strings pulling at the end of the neck, the tendency is for the neck to bow concavely.

Particularly under humid conditions, the neck, often made of wood, will have an even greater tendancy to bow or warp. Thus, strings which have been properly tensioned will gradually loosen because of the neck curving concavely. Further, the distance between the strings and the fingerboard on the neck will increase as the bowing of the neck increases, resulting in poor fingering of the strings. Also, because of the wood construction of the neck and the tension imposed upon it, breakage of the neck is a possibility.

In response to these considerations, several reinforcing and wrap counteracting devices have been introduced. The simplest of these devices is in the form of a metal truss rod having threaded ends. One end engages an anchor, and the opposite end engages a tension nut and an associated washer. The anchor holds the truss rod end in an axially stationary position relative to the instrument's neck. The truss rod is tensioned into a concave configuration relative to the strings and is positioned into an accomodating groove which runs the length of the instrument's neck. The groove includes a cylindrical bore at one end of the neck through which one end of the truss rod protrudes. The tension nut washer, positioned over the end of the protruding truss rod, abuts a shoulder surrounding the bore opening and remains axially stationary thereto. The tension nut is threaded onto the protruding threaded rod end adjacent to the washer. An elongate filler strip, having the same general arcuate shape of the elongate groove and bowed truss rod positioned therein, is glued into the groove, over the truss rod enclosing the truss rod between the strip and the neck of the instrument. Finally a fingerboard is generally glued in place over the filler strip.

Concave bowing of the neck due to the pull of the strings is corrected by rotation of the nut about the threaded truss rod end, causing axial movement of that rod end relative to the washer and instrument neck. Tightening of the nut decreases the effective length of the bowed truss rod between the anchor and washer, causing the rod to pull downwardly on the ends of the neck away from the strings and to force the neck upwardly at the middle of the arcuate filler strip. The net effect of these forces causes the neck to bow convexly relative to the strings. The degree of this convex force is adjustable by tightening or loosening the tension nut.

The concave bow of the neck in this simplest truss rod device generally is limited to the degree of bow imparted to the neck during its construction with the tension nut loose, coupled with the forces exerted by the tightened instrument strings in the completed instrument. This is because no means for increasing the effective truss rod length are provided; the rod can only be shortened. Variations on this simple truss rod theme are exemplified by U.S. Pat. Nos. 4,074,604 to Fender (central portion of truss rod flattened in a plane perpendicular to the bow of the truss rod), and 4,167,133 to Adams (rod replaced by a tensionable strap), the disclosures of which are incorporated herein by reference.

Both concave and convex bowing of a single truss rod to correct neck warp have been advanced in U.S. Pat. No. 3,159,072 to Burns et al, the disclosure of which is incorporated herein by reference. In the Burns device, an anchored toothed wheel-worm gear mechanism alternately lengthens or shortens the effective length of a truss rod between the gear mechanism and a distal rod anchor, the double action providing convex and concave bowing, respectively.

Another device is known for alternately lengthening or shortening effective truss rod length to achieve both concave and convex bowing by a single truss rod device lacking a worm gear mechanism. Simply, a single rod is threaded on both ends, over each of which is threaded an anchor nut. A head is brazed or welded to one end of the rod in order to turn the rod. Thus, with the anchor nuts firmly embedded within and at either end of the instrument's neck, the effective length of the rod between the anchor nuts may be increased or decreased by turning the rod, by its head, thereby providing convex or concave neck bow.

While the foregoing devices ultimately achieve the result of counteracting convex or concave neck warp, several basic problems arise from their use which have not been adequately addressed. The major problem with the foregoing devices is their repair. Because the truss rod is compressed between the filler strip and the instrument's neck, being further overlaid by a fingerboard, dismantling of the neck is necessary to gain access to the rod. Most frequently, the need for repair arises due to the stripping of the threads at the truss rod end. Once the threads are stripped, the tension nut may no longer be tightened. As a consequence the curvature of the neck may no longer be adjusted. Generally, once the threads on a rod are stripped, it is necessary to replace the entire rod. However, removal of the fingerboard and filler strip in order to reach the rod is no easy task, as these are generally firmly glued into position on the instrument's neck. Prying these components loose usually results in their being damaged in some way. Further, even after the rod is exposed, it too must be pried loose from its groove potentially resulting in even further damage to the instrument's neck. Such a consequence would be especially devastating where the instrument being repaired is one of great value or age.

Occasionally, the rod may pull free from its anchor. Repair of this problem is perhaps more easily effected since the rod simply needs to be reattached to its anchor, perhaps by welding or brazing. Although this problem arises infrequently, it still necessitates the removal of those components which cover the anchor in order to reach it.

Another problem relating to the foregoing truss rod devices is the amount of space they take up within the instrument's neck. The neck of the instrument is fragile enough to begin with. Carving out grooves and spaces for rods, anchors and tension nuts removes more wood of the fragile neck than is desirable. One point of the neck especially vulnerable to breakage is the junction between the instrument neck and the peghead. The peghead is a flattened structure contiguous with and at an angle to the end of the instrument's neck. Apertures in the peghead accomodate pegs to which the strings attach. The strings may then be tensioned in order to tune the instrument simply by winding them up onto the pegs. Due to the pulling forces exerted by the strings on the pegboard neck junction, breakage at this point is most common. Hollowing out a portion of the neck in this especially vulnerable region to accomodate either a rod anchor or tension nut results in even greater vulnerability to breakage. Ideally there would be no hollowed out portions at this pegboard neck junction.

In truss rod devices where the rod itself must rotate in order to effectively shorten the rod length, a problem in installation arises. Because the rod must be free to rotate within the neck, the groove accomodating the rod must not bind the rod and, more importantly, glue which attaches the fingerboard, and any filler strip to the neck must not adhere to the rod. While some methods for preventing the rod from being glued are used, such as surrounding the rod with wax paper or periodic rotation of the rod while the glue sets, any failure of these methods necessitates complete dismantling of the neck in order to free up the rod. Also, if the groove is too large for the rod, the rod will vibrate sympathetically with the string vibrations when the instrument is being played.

Although single truss rod devices have been effective in correcting concave warping of the neck, they have been less effective for correcting convex warp because of the need to impose a pretensioned concave bow on the rod within the neck. Further, these devices are difficult to install and repair. In order to satisfy the need for more effective double action truss rod devices, two addition devices have been proposed.

The first of these consists of a rigid sleeve along the length of the neck. Movable core elements within the sleeve cooperate with core elements secured to the sleeve, thereby imparting deflection of the sleeve and neck. Unfortunately, such an apparatus is subject to the same access for repair constraints already discussed. Further, such a device is necessarily complex, and consequently more difficult to manufacture and use, as well as expensive.

A second approach to the problem of effective concave and convex adjustment of neck warp involves using a truss rod apparatus having two rods, an example of which is taught by U.S. Pat. No. 3,416,399 to Baldoni, the disclosure of which is incorporated herein by reference. Here, parallel rods, threaded at each end, are tensioned into a concave bow relative to the strings. The bowed rods are held bowed by a filler strip within an arcuate groove along the length of the neck. Anchors secure each rod at one end of the neck while turnbuckles, anchored at the opposite end of the neck, engage each rod independently in order to increase or decrease the rod's effective length. In so doing, it is possible to counteract concave and convex bowing to the same degree as would be achieved by having two truss rod devices of the type disclosed in the U.S. Pat. No. 3,159,072 to Burns embedded in the neck in parallel relation. Thus, a doubled force to counteract convex and concave warping, as well as some lateral warp correction, can be achieved by using the Baldoni device. However, because wood grains in the instrument neck generally run the length of the neck, lateral warp in unlikely. Further, the repair problem for the Baldoni device now is doubled as two rods having the same drawbacks as all of the previous single truss rod devices are embedded in a single neck.

Yet an additional example of known truss rod devices is a double rod assembly which may be bowed in only one direction. This device consists of two straight parallel rods which are joined together at one end. At their opposite unjoined ends, the rods are attached to an anchor. One rod is fixedly attached to the anchor while the other rod passes through the anchor to thread with a tension nut on the other side. By tightening the tension nut, the effective length of the rod with which it threads is shortened, causing the rod pair to bow. Loosening of the tension nut will return the rod pair to its straight configuration by returning the shortened rod to its original length. This device is installed within the instrument neck in the straight, untensioned condition. Thus, the necessity of an arcuate groove is eliminated. Further, a filler strip is now unnecessary since no structure is needed to maintain the rod in a bowed condition. A fingerboard may be glued directly to the instrument's neck in order to cover the truss rod lying within the straight neck groove. In order to prevent glue from binding the length adjustable rod, the rods are ordinarily covered with a protective cover which allows the rods to slide freely within. Further, because the rods act upon each other in order to bow, there is need for only one anchor. By placing the device within the groove so that the end where the rods are joined together is nearest the pegheadneck junction, very little supportive wood needs to be removed from there. This greatly increases the strength of this region. More importantly, repair is simplified since the entire device within a completed neck can be easily removed from the neck simply by pulling it out from the base of the neck where an opening to the groove is provided to accomodate the anchor. Thus, instead of removing the glued fingerboard and filler strip to gain access to an anchor or tension nut near the fragile pegboard neck junction, the entire apparatus can simply and quickly be removed from the sturdier base of the instrument neck.

The major drawback of this type of apparatus is that it can correct warp in the neck by bowing in only one direction. Presumably, correction of neck warp in an opposite direction could be achieved, but only by removing the apparatus from the base of the neck and turning it over, so that the bow would now be appropriate to counteract that opposite warp. Such a corrective measure is entirely inadequate for day to day use of an instrument. The net result of using known truss rod devices is that concave and convex neck bow can be corrected, but significant shortcomings remain as regards installation, use, and repair.

SUMMARY OF THE INVENTION

The present invention overcomes the foregoing and other drawbacks of the prior art by providing a novel truss rod apparatus, in use positioned within the neck of a stringed musical instrument, for correcting both concave and convex warping of the instrument's neck. The apparatus occupies little space within the neck and is easily removed or replaced without disassembling the neck. More importantly, both concave or convex neck warp is corrected simply and effectively by turning a single bolt.

The apparatus includes a first and second flexible metal rod, each held parallel to each other and fastened together at one end. The free end of the first rod is fastened to an anchor block. The anchor block itself defines a passageway through which the free end of the second rod is axially movable relative to the anchor block and first rod. Axial movement of the second rod is accomplished by a length adjustment mechanism whereby the length of the second rod may be alternately increased or decreased relative to the first rod. Adjusting the length of the second rod relative to the first rod causes both of the rods to bow arcuately.

In use, the rod pair extends the length of the instrument neck, being held snugly within a narrow groove which also extends the length of the neck. Sleeves cover the rod pair to prevent their being bound or glued within the neck. A widening of the groove, open to the outside of the base of the neck, accomodates the anchor block. A fingerboard is affixed to the instrument neck to completely enclose the apparatus within the neck. In the preferred embodiment, the parallel rods lie in a vertical plane, perpendicular to the longitudinally planar fingerboard. Thus, any warp of the instrument neck due to such factors as the pull of the strings or humidity may be corrected by lengthening or shortening the adjustable rod, causing the rod pair to bow arcuately, thereby forcing the neck to conform to the bowed shape imposed by the apparatus within.

In the preferred embodiment, the length adjusting mechanism includes a hollow bolt having internal threads and external threads. The internal threads have a smaller pitch than the external threads. The external threads of the bolt engage threads within the passageway defined by the anchor block. The internal bolt threads engage threads on the end of the second, length adjustable rod. Thus, the effective length of the second rod may be alternately increased or decreased, depending upon the degree of axial bolt movement caused by the bolt's rotation within the threaded anchor block passageway.

These and other features and advantages, and a fuller understanding of the invention, may be had by reference to the following description and claims, taken in conjunction with the accompanying drawings.

DESCRIPTION OF THE PREFERRED EMBODIMENT

Figure 1:
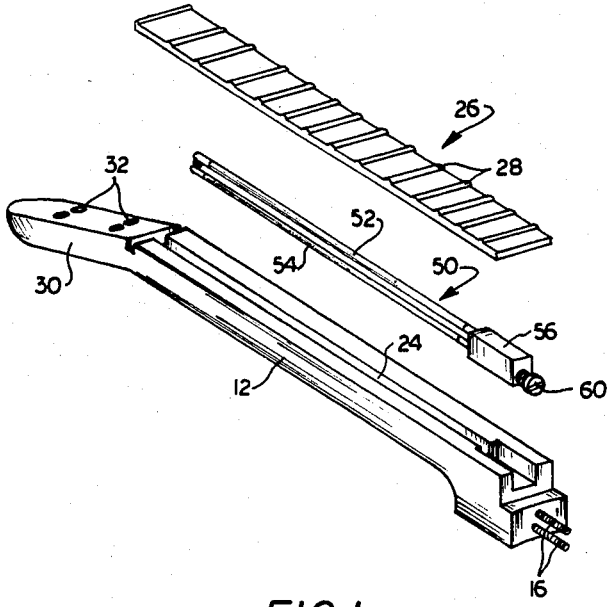
FIG. 1 is an exploded perspective view of a banjo, showing the truss rod apparatus according to the present invention.

Referring to FIG. 1, a truss rod apparatus 50 is depicted in relation to a banjo 10, the banjo 10 being depicted only as an example of various stringed musical instruments to which the invention may be applied. Banjo 10 includes a neck 12 attached to a circular body 14 by bolts 16. Body 14 is covered on top with a tightly stretched skin 18. Skin 18 is held in a stretched condition by a retaining ring 20 and ring tie-down screws. Neck 12 has a groove 24 along the length of the neck by which the truss rod apparatus 50 is snugly held. Fingerboard 26, with fingering frets 28, is glued in place over groove 24 and truss rod apparatus 50. Neck 12 also has peghead 30 having peg holes 32 into which string-tensioning pegs (not shown) are inserted.

Figure 2:
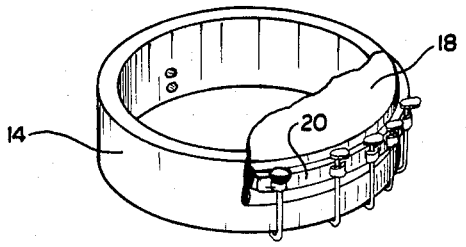
FIG. 2 is a longitudinal cross-section through the neck of the banjo showing the truss rod apparatus.
Figure 2:
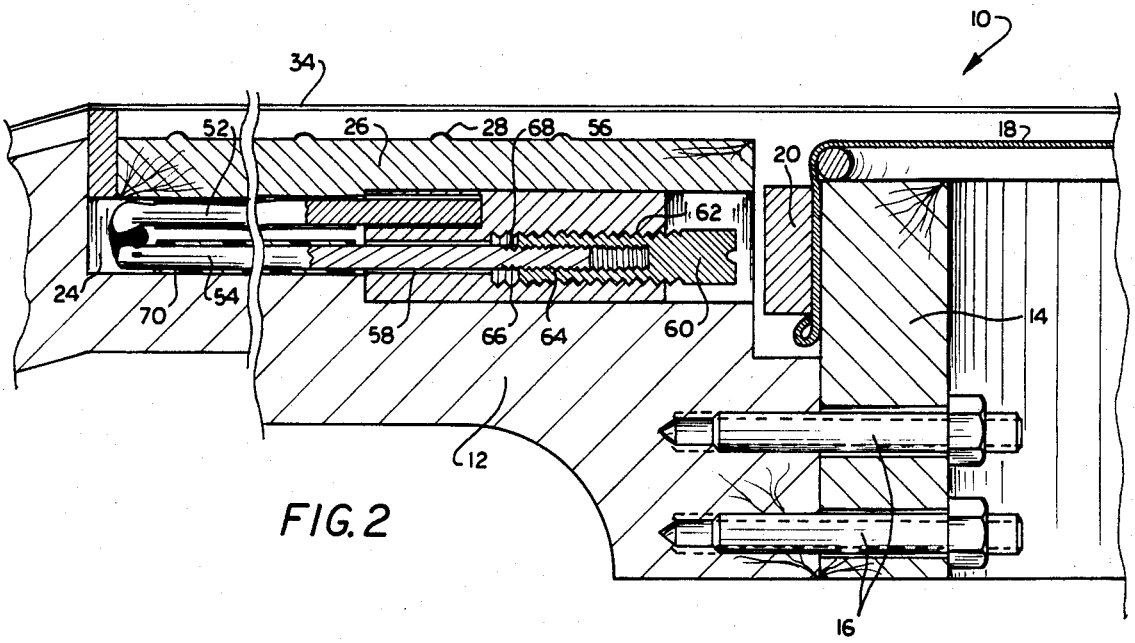
Figure 5:
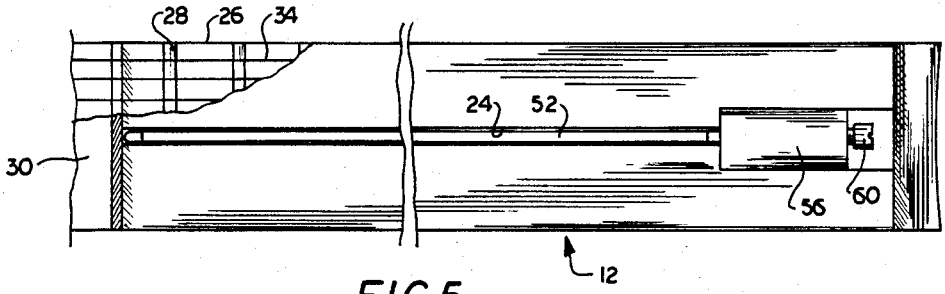
FIG. 5 is a plan view of a portion of a fingerboard which has been cut away to show the underlying truss rod apparatus disposed within a groove in the instrument neck.
Figure 6:
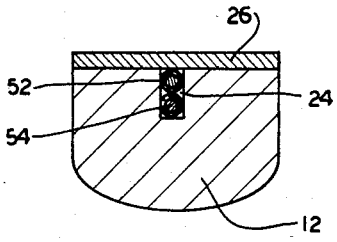
FIG. 6 is a cross-sectional view taken along a plane indicated by line 6—6 FIG. 4.

Referring to FIGS. 2, 5, and 6, truss rod apparatus 50 is shown within groove 24 in the instrument neck 12. Truss rod apparatus 50 includes a first rod 52 and a second rod 54. Second rod 54 is parallel to first rod 52 and joined to one end of first rod 52. An anchor block 56 is snugly held within a widened end of groove 24. Fixedly attached to anchor block 56 is first rod 52. Anchor block 56 has a passageway 58 defined therethrough, through which the second rod 54 is axially movable. Rods 52 and 54, as well as anchor block 56, preferably are made of a metal such as steel.

In the preferred embodiment, axial movement of the second rod 54 is accomplished through use of a hollow threaded bolt 60. Bolt 60 has external threads 62 and internal threads 64. The threads 62 have a higher pitch than the threads 64. The external bolt threads 62 engage threads 66 formed by the walls of the anchor block passageway 58. Internal bolt threads 64 engage threads 68 on the end of the second rod 54. Bolt 60 is preferably made of a metal softer than steel, such as brass. Use of a softer metal helps to eliminate corrosion and binding between the bolt 60 and structures with which it threads. Further, in the event threads should strip, it is more economical to simply replace bolt 60 than either rods 52, 54 or anchor block 56. In addition to the foregoing components, the rods 52, 54 are provided with anti-friction sleeves 70. The anti-friction sleeves 70 may be in the form of inexpensive plastic tubing positioned on the rods 52, 54.

In operation, turning of bolt 60 causes its axial movement within the anchor block passageway 58. Because the threads 64 of bolt 60 engage the threads 68 at the end of second rod 54, rod 54 is moved axially as bolt 60 moves axially. Axial movement of rod 54 is not of the same magnitude as that of bolt 60 due to the disparity in pitch of the threads 64 and the threads 62. Further, rotation of bolt 60 causes it to move axially within the passageway 58 and about the threads 68 at the end of rod 54. In contrast, rod 52 is moved axially while remaining radially stationary. Sleeves 70 facilitate the movement and bowing of rods 52 and 54 within neck 12.

Other methods of achieving the desired result of radial immobility during axial movement of rod 54 are contemplated here, for example, a ball and socket arrangement. Such an arrangement would replace the threads 68 of the end of rod 54 with a ball and the internal threads 64 of bolt 60 with a socket. Thus, the ball engaged in the socket would provide a means for axially moving rod 52 without its radial rotation. Various equivalent techniques will be apparent to those skilled in the art.

Figure 3:
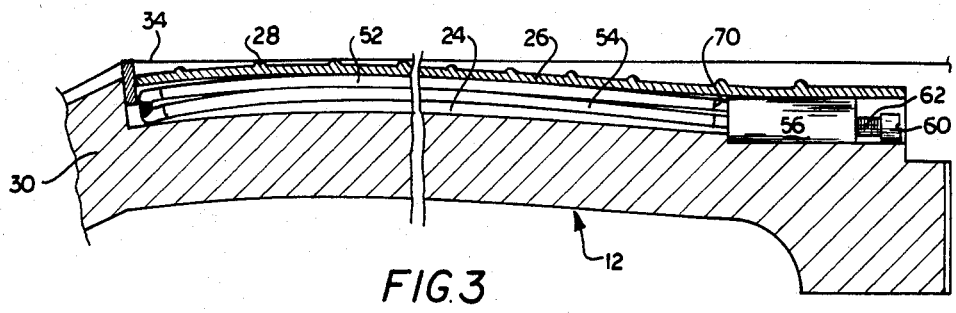
FIG. 3 is a longitudinal cross-section through the instrument neck, showing an exaggerated convex arcuate bow of the neck caused by the shortened effective length of the adjustable rod.
Figure 4:
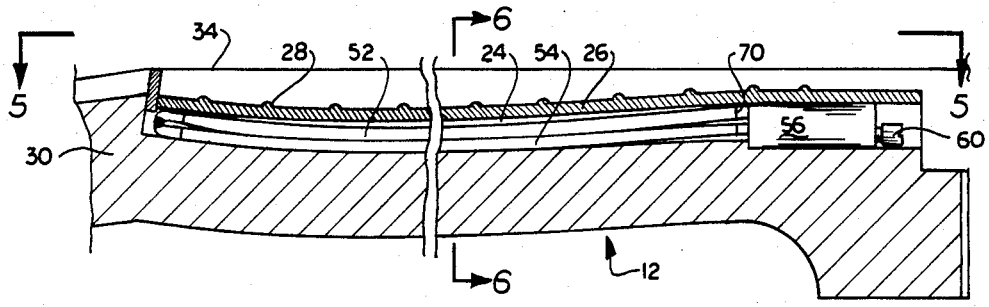
FIG. 4 is a longitudinal cross-section through the instrument neck showing an exaggerated concave arcuate bow of the neck caused by the increased effective length of the adjustable rod.

Referring to FIGS. 3 and 4, the action of truss rod apparatus 50 within neck 12 of a stringed musical instrument is shown. The degree of curvature imparted to the neck by apparatus 50 as depicted in FIGS. 3 and 4 has been exaggerated for purposes of illustration. As can be seen in FIG. 3, bolt 60 is shown extended from anchor block 56, indicating that the effective length of rod 54 has been shortened. As a result, rods 52 and 54 bow convexly relative to strings 34. The force of the bowed truss rods 52 and 54 is imparted to neck 12, forcing it to follow suit.

Referring to FIG. 4, bolt 60 is shown screwed into anchor block 56, indicating that the effective length of rod 54 has been increased. As a result, rods 52 and 54 bow concavely relative to string 34. Thus, neck 12 is forced to follow suit.

Thus, in order to counteract a concave warp in neck 12, an equal force in the opposite or convex direction is imparted to the neck 12 by way of the truss rod apparatus 50; in the case illustrated by the FIGURES, by shortening the effective length of rod 54. Conversely, to counteract a convex warp in neck 14, the effective length of rod 54 is increased, imparting a force in the opposite or concave direction, thereby straightening the neck.

In those cases where no forces are acting upon neck 12, or warp counteraction is unneccesary or undesired, the simple rotation of bolt 60, so as to equalize the effective length of rod 54 to the fixed effective length of rod 52, eliminates any bowing of rods 52 and 54 and thus eliminates any forces exerted on neck 12. This is an advantage over certain prior truss rod devices which require that the instrument be assembled with a "preloading" applied to the devices and, in turn, to the neck. Accordingly, the present invention makes it possible to apply less stress to the neck under various conditions; longevity of the instrument therefore is enhanced.

Should the need to repair any element of the described truss rod apparatus 50 arise, the entire apparatus 50 can be easily removed by simply pulling it from groove 24 through the widened region of the groove 24 which opens to the outside at the base of neck 12. Again, this feature is an advantage over certain prior devices which require that virtually the entire instrument be disassembled in order to repair or replace the truss rod device.

Although the invention has been described in its preferred form with a certain degree of particularly, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. An apparatus for adjusting neck curvature in a stringed musical instrument, comprising:

(a) a first elongate member having a first end and a second end;

(b) a second elongate member positioned adjacent to and parallel to said first elongate member, the second elongate member having a first end and a second end, the first end of the second elongate member being fixedly connected to the first end of the first elongate member;

(c) anchoring means to which the second end of the first elongate member is fixedly attached, the anchoring means being positioned at one end of the musical instrument neck; and (d) rod length adjusting means threadedly engaged to said anchoring means and said second end of said second elongate member, so that upon movement of said rod length adjusting means in one direction or another, said rod length adjusting means applies a tension force or a compressive force, respectively, to said second elongate member.

2. The apparatus as recited in claim 1, wherein the first elongate member is a flexible rod.

3. The apparatus as recited in claim 2, wherein the rod is made of metal.

4. The apparatus as recited in claim 1, wherein the second elongate member is a flexible rod.

5. The apparatus as recited in claim 4, wherein the rod is made of metal.

6. The apparatus as recited in claim 1, wherein the first end of the second elongate member is welded to the first end of the first elongate member.

7. The apparatus as recited in claim 1, wherein the anchoring means is a metal block.

8. The apparatus as recited in claim 1, further comprising anti-friction sleeves disposed about the first and second elongate members.

9. An apparatus for adjusting neck curvature in a stringed musical instrument, comprising:

(a) a first elongate member having a first end and a second end;

(b) a second elongate member positioned adjacent to and parallel to said first elongate member, the second elongate member having a first end and a second end, the first end of the second elongate member being fixedly connected to the first end of the first elongate member;

(c) anchoring means to which the second end of the first elongate member is fixedly attached, the anchoring means being positioned at one end of the musical instrument neck; and (d) rod length adjusting means having a hollow threaded bolt having internal threads and external threads, the internal bolt threads threadedly engageable with external threads on the second end of the second elongate member, the external bolt threads threadedly engagable with a threaded passageway through the anchoring means, said length adjusting means being connected to the second end of the second elongate member for axial movement and length adjustment of said second elongate member relative to the first elongate member and the anchoring means.

10. The apparatus as recited in claim 9, wherein the bolt is made of a soft metal.

11. The apparatus as recited in claim 10, wherein the soft metal is brass.

12. The apparatus as recited in claim 9, wherein the external bolt threads have a greater pitch than the internal bolt threads.

13. A truss rod apparatus, in use situated within the neck of a stringed musical instrument, for variably adjusting neck warping of the instrument, comprising:

(a) a first rod;

(b) a second rod parallel to the first rod and joined at one end to one end of the first rod, the free end of the second rod having threads;

(c) an anchoring block to which the first rod is joined, the block having a threaded passageway defined therethrough, the second rod being axially movable within the passageway; and (d) a hollow threaded bolt, the bolt having external threads and internal threads, the external threads having a greater pitch than the internal threads, the external threads threadedly engagable with the threads in the block passageway, the internal bolt threads threadedly engagable with the threads on the free end of the second rod, whereby the second rod may be axially extended or retracted relative to the block without radial movement of the rod.

* * * * *